US007108613B1

(12) United States Patent
Gordon et al.

(10) Patent No.: US 7,108,613 B1
(45) Date of Patent: Sep. 19, 2006

(54) GOLF CLUB HEAD

(76) Inventors: David Gordon, Lot 2, Godfry Place, Alstonville (AU) NSW 2477; David John McIntosh, 19 Wyuna Crescent, Ballina (AU) NSW 2478; Donald John Whitelaw, 114 Taylors Road, Chilcotts Grass (AU) NSW 2480

( * ) Notice: Subject to any disclaimer, the term of this patent is extended or adjusted under 35 U.S.C. 154(b) by 364 days.

(21) Appl. No.: 10/110,962

(22) PCT Filed: Oct. 18, 2000

(86) PCT No.: PCT/AU00/01259

§ 371 (c)(1),
(2), (4) Date: Aug. 26, 2002

(87) PCT Pub. No.: WO01/28640

PCT Pub. Date: Apr. 26, 2001

(30) Foreign Application Priority Data

Oct. 18, 1999 (AU) ..... PQ3517

(51) Int. Cl.
*A63B 53/04* (2006.01)
*A63B 53/06* (2006.01)

(52) U.S. Cl. ..... 473/341; 473/349

(58) Field of Classification Search ..... 473/251, 473/256, 313, 324, 334–337, 340, 341, 343
See application file for complete search history.

(56) References Cited

U.S. PATENT DOCUMENTS

| | | | | |
|---|---|---|---|---|
| 2,654,608 | A * | 10/1953 | Liebers | 473/343 |
| 4,444,395 | A * | 4/1984 | Reiss | 473/335 |
| 4,775,156 | A * | 10/1988 | Thompson | 473/328 |
| 5,244,210 | A | 9/1993 | Au | |
| 5,324,031 | A | 6/1994 | Green | |
| 5,766,093 | A | 6/1998 | Rohrer | |
| 5,876,293 | A | 3/1999 | Musty | |
| 6,328,662 | B1 * | 12/2001 | Huang | 473/334 |

FOREIGN PATENT DOCUMENTS

| | | | |
|---|---|---|---|
| JP | 09070455 A | * | 3/1997 |
| JP | A 9-206412 | | 8/1997 |

* cited by examiner

*Primary Examiner*—Eugene Kim
*Assistant Examiner*—Alvin A. Hunter, Jr.
(74) *Attorney, Agent, or Firm*—Young & Thompson

(57) ABSTRACT

A golf club head has two metal outer ends to and a mid-section composed of multiple side-by-side, polymeric laminations (14) directed substantially transversely to the club face (4). In one version the threaded rod (12) joins the ends compressing the laminations. The laminations allow bands of color or opacity to create a distinctive appearance. In another version the laminations are replaced by a moulded block of polymer (24).

16 Claims, 4 Drawing Sheets

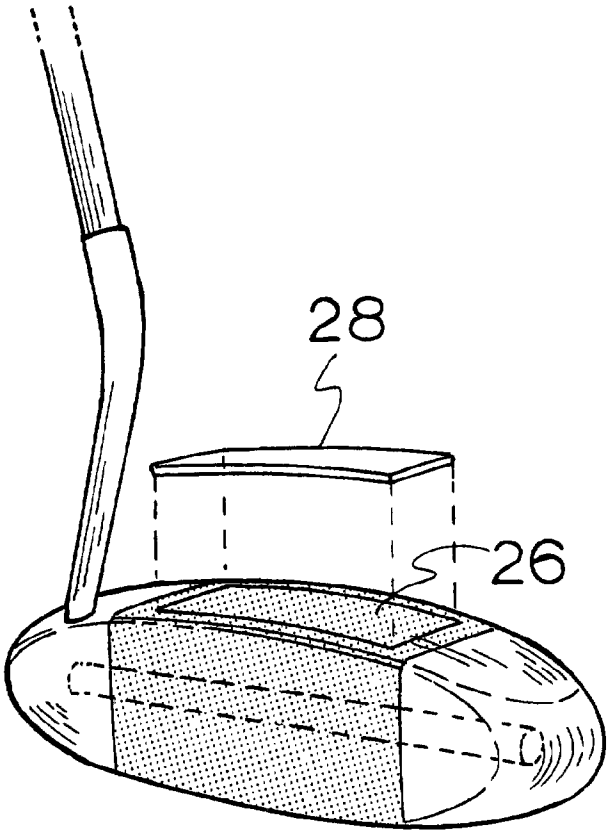
FIG.5.
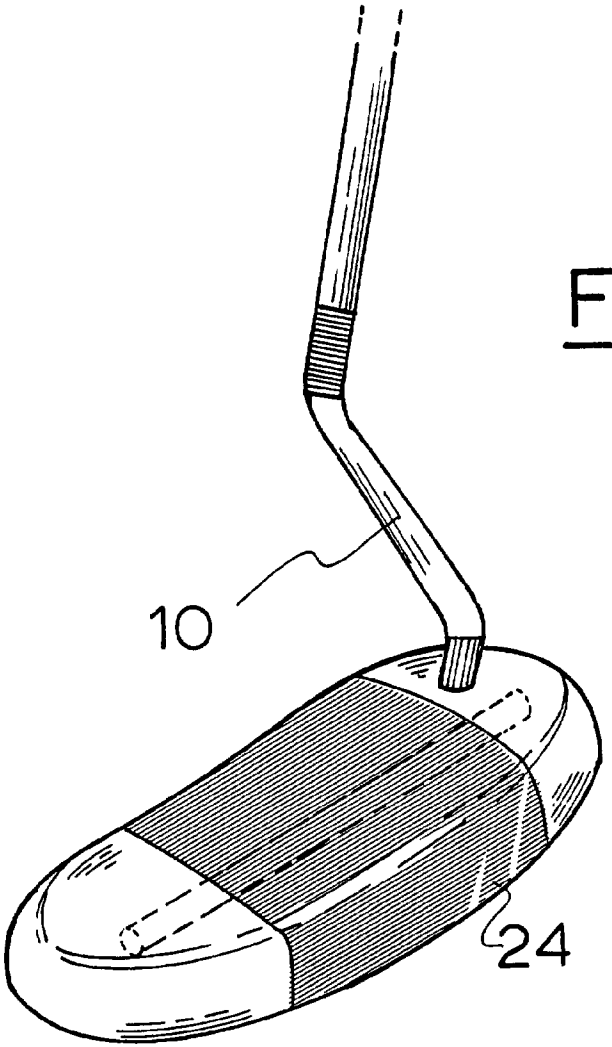

GOLF CLUB HEAD

TECHNICAL FIELD OF THE INVENTION

THIS INVENTION concerns golf club heads and particularly, but not exclusively, putter club heads.

BACKGROUND OF THE INVENTION

Putters tend to attract experimentation in the use of different materials. If the club head is to impart a different feel when hitting a golf ball, a material, which is more elastic than the metal which is the chief constituent of known putter heads, is required. It is possible to provide this softer material as an insert but the provision of insufficient volume of the insert material to change the feel, means that a compensating quantity of metal must be used to provide reasonable mass.

Some golfers prefer to personalise their clubs but the construction of clubs usually confines distinctive markings to surface embellishments, logos or labels. If these are applied to the club head, wear tends to eventually obscure them.

OBJECT OF THE INVENTION

An object of the present invention is to alleviate or to reduce to a certain level one or more of the above prior art disadvantages.

SUMMARY OF THE INVENTION

In one aspect of the invention, we provide a golf putter having a composite club head wherein at least the mid-section of which is composed of multiple side by side laminations directed substantially transversely to the club face, the laminations creating a banding pattern which permits identification.

The laminations may be of equal or unequal thickness, opacity, density and cross-sections. The laminations may be made of substantially water impervious sheet material. Ceramic is acceptable but softer materials which can be shaped by workshop processes are preferred. Rubber and rubberlike polymers, for example, polyurethane are useful. Harder polymers such as methacrylates and polycarbonate are preferred giving a lively, elastic feel to the stroke.

The parts of the club head which are separated by the laminations and add mass but do not contact the ball, may be made of metal. Wood or polymer with metal inserts are acceptable but metal is preferred to give the club head suitable mass.

The laminations may be joined together by a clamping tie passing through the laminations, extending between the ends of the club. The rod may seem to simply enter threaded blind bores in the ends, clamping the laminations between the ends by screw pressure. The ends may be contoured so as to impose C-shape or S-shape on the laminations. The laminations may be coloured in at least the marginal surface zone so that the colour seems to be uniform through the thickness of the club head. This permits dents and scratches to be buffed away. In addition to clamping it is preferable to secure the laminations face to face by adhesive.

Thus distinctive appearances may be imparted by selection of colours or opacities. Decorative inserts or inlays of contrasting appearance may be incorporated into the laminated mid-section, for example, monograms. The ends may be plated or given suitable surface finishes. The laminations may be varied in composition in order to create a "sweet spot" in the centre of the laminated section. The club head may be connected to the putter shaft by a crank. The crank may be threaded at both ends.

In a variant aspect the invention provides a composite club head in two or more parts comprising one or more metal parts and a mid-section which is a block of solid, elastic, polymeric material. Preferably the head comprises a mount and cap made of the same material, preferably metal, to give the required mass and a centre part made of polymer the parts being screwed together on a rod which joins all three.

In a method aspect the putter club head is made by nipping a row of laminations between a pair of parts which define the ends of the club head and adhering the assembly into a composite head.

The parts may be mutually connected by a tie upon which the laminations are threadable and the tie is used to compress the laminations. The laminations may be shaped or finished to give the club head its final desired shape.

BRIEF DESCRIPTION OF THE DRAWINGS

Some examples of the invention are now described by way of example with reference to the accompanying drawings in which:

FIG. 5 is a perspective view of a variant.

DETAILED DESCRIPTION OF THE DRAWINGS

Figure 1:
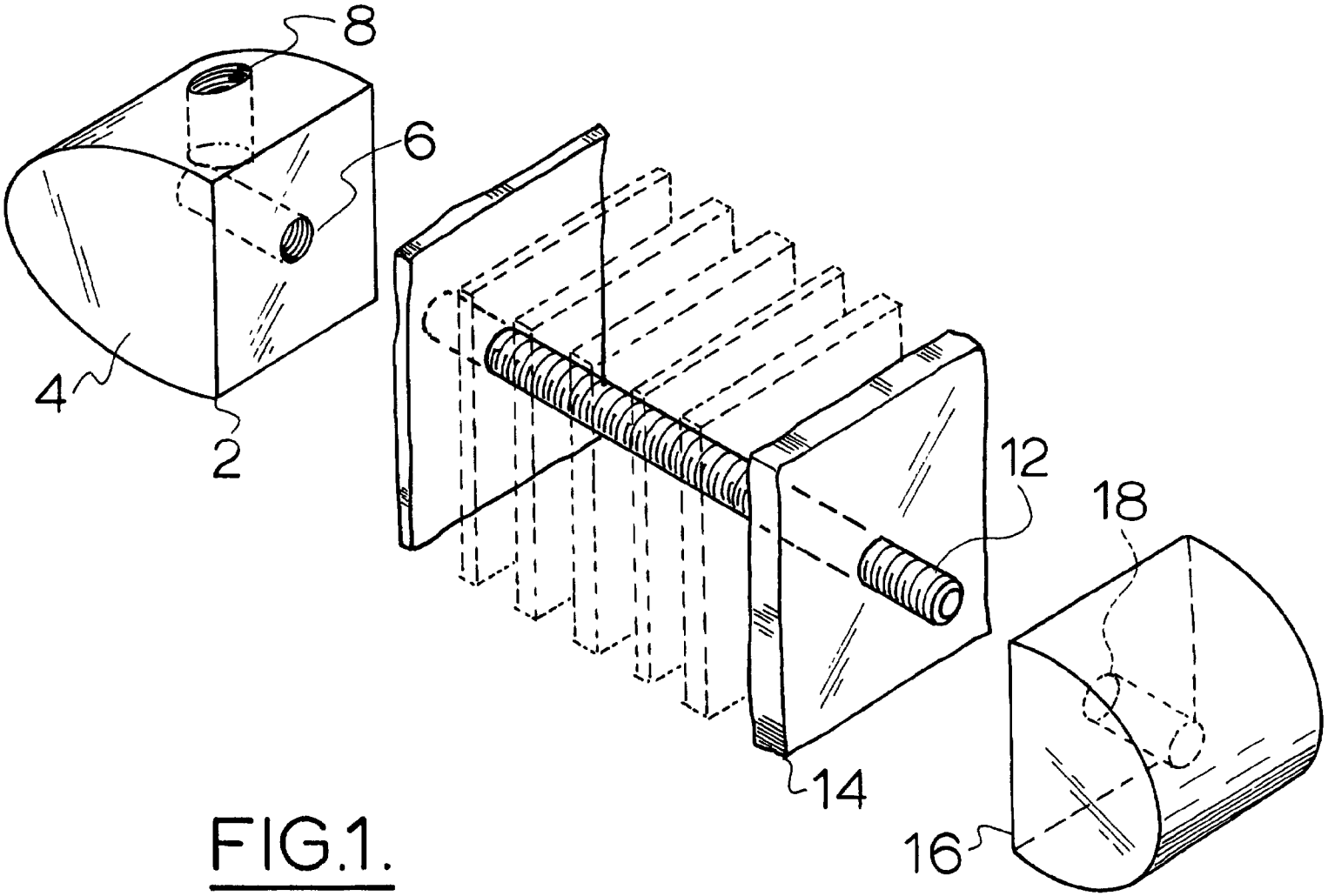
FIG. 1 is an exploded view of the components.
Figure 2:
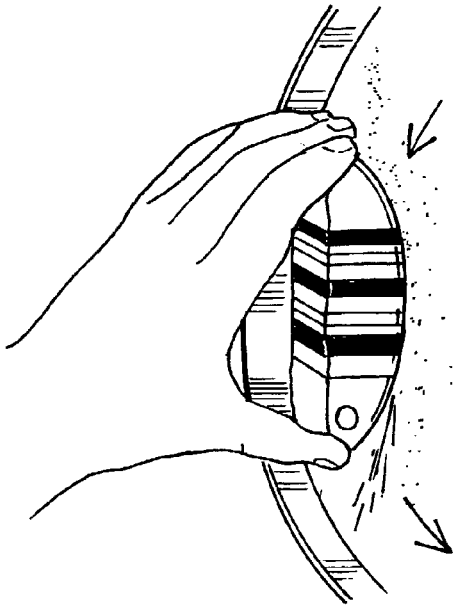
FIG. 2 shows the club head being assembled and sanded.
Figure 2:
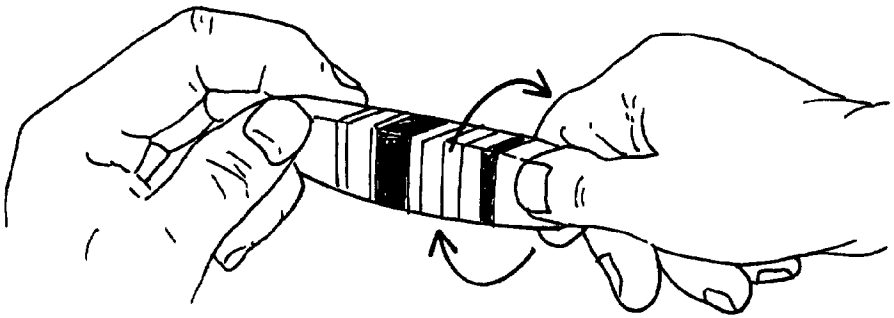
Figure 3:
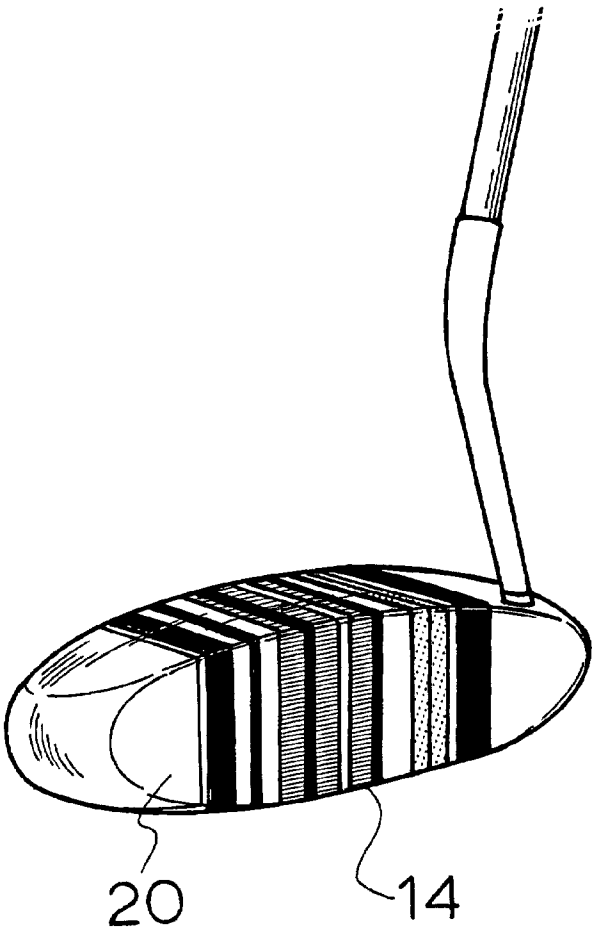
FIG. 3 is a perspective view of the club head and crank.

Referring now to FIGS. 1, 2 and 3, a mount 2 is a brass forging with a flat face 4. The flat face has a blind threaded bore 6. A like threaded bore 8 is located in the mount 2 for receiving a stainless steel crank 10 (see FIG. 5). A stainless steel rod 12 with threaded ends carries a series of side by side square or D-shaped laminations 14, being 35×50 mm sheets of polyurethane each 3 mm thick. The sheets are adhered with epoxy adhesive.

The cap or toe section 16 has a blind bore 18 to receive the end of the rod. The cap and mount are screwed together to compress the aligned laminations which present a uniform flat face 20 to the golf ball.

Figure 4:
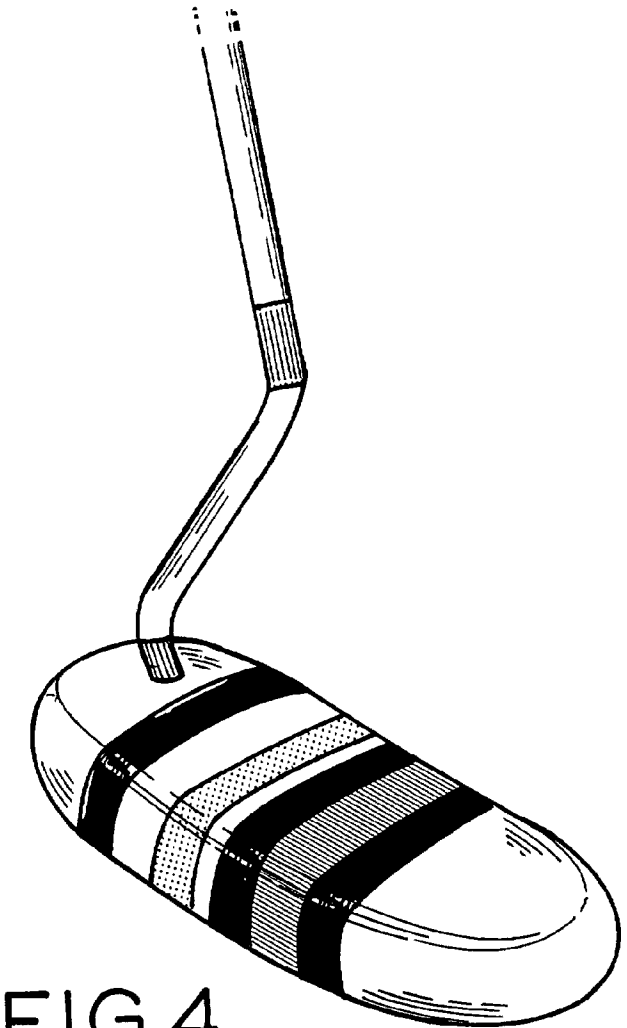
FIG. 4 is a perspective view of the club head and crank showing different banding.

Referring now to FIGS. 2, 3 and 4 the laminations are of different colours and are arranged in bands of colour to give a distinctive combination of green and yellow bands representing the sporting colours of Australia. The laminations are coated on the contiguous faces with epoxy adhesive and threaded onto the rod. The mount and cap are screwed onto the ends of the rod and the front edges of the laminations are placed in register to form the putter face. The laminations are compressed to give a seamless surface. The curved surface of the laminations are sanded to mate with the cap and mount. The head is transferred to a plating bath. The crank 10 is screwed into the mount and the shaft is added.

In another version shown in FIG. 5, the laminations are substituted by a solid block 24 made from a die. The block has an integral bore for the rod and a chased area 26 for an inlay 28 such as a corporate logo.

In yet another version, the laminated portion is made by pouring a layer of a coloured liquid acrylic polymer mix and hardening the mix with UV light before adding a layer of contrasting colour and repeating the operation until a hard striped block is obtained. This method makes bands which are horizontal inclined rather than vertical.

In this specification transparent and translucent laminations exert the same effect as coloured ones and are equivalent.

In a further example the polymer mix is colourless but contains a photo-activated dye which is selectively exposed to light in order to create a banded effect. A variation of the latter construction is a mid-section block covered by a mask with coloured bands which simulates a laminated centre section. This is in turn protected by a transparent sheath.

These methods are considered equivalent because they too reproduce the distinctive appearance rendered possible by the separate laminations.

Whilst the above has been given by way of illustrative example of the present invention many variations and modifications thereto will be apparent to those skilled in the art without departing from the broad ambit and scope of the invention as set out in the appended claims.

The invention claimed is:

1. A golf putter comprising:

a composite club head having a toe section, heel section and a mid-section arranged between the toe and heel sections wherein the toe, heel, and midsection presents a front club face for striking a golf ball;

wherein at least said mid-section is composed of a laminated body formed of multiple side-by-side laminations with sides of the laminations directed substantially transverse to the club face, and a clamping tie rod passing through said sides of said laminations wherein ends of said tie rod extending outwardly from said laminated body in opposite directions, and said toe and heel sections being connected to a respective end of said tie rod and being arranged to compressively clamp said laminations and wherein said toe section has one or more metal parts and said heel section has one or more metal parts.

2. A golf putter as claimed in claim 1, wherein the laminations are arranged to create a banding effect.

3. A golf putter as claimed in claim 2 wherein the laminations are of unequal thickness.

4. A golf putter as claimed in claim 1 wherein the laminations are made of a substantially water impervious material which is capable of being shaped by workshop processes.

5. A golf putter as claimed in claim 1 wherein the laminations are made of rubber, a polyurethane, a methacrylate or polycarbonate polymer.

6. A golf putter as claimed in claim 1 wherein at least some of the laminations are coloured in at least a marginal surface zone so that the colour appears to be uniform through the thickness of the club head.

7. A golf putter as claimed in claim 1 wherein the laminations are given a distinctive appearance by selection of colours or opacities.

8. A golf putter as claimed in claim 1 in which the laminations vary in composition in order to create a "sweet spot".

9. A golf putter as claimed in claim 1, wherein the laminations are compressively clamped by screw pressure of the tie rod and by adhesive applied to the sides of the laminations.

10. A golf putter as claimed in claim 1 wherein each said toe and heel sections having a threaded blind hole and the tie rod is threaded and arranged to engage the threaded blind bores for connection with the toe and heel sections.

11. A golf putter as claimed in claim 1, wherein faces of the toe and heel sections which lie adjacent the mid-section are contoured so as to impose a C-shape or S-shape on the mid-section.

12. A golf putter according to claim 1, comprising a composite head formed multiple parts and each lamination of said mid-section being sheet solid elastic polymeric material.

13. A golf putter as claimed in claim 12, wherein the tie rod is threaded, and the toe section and the heel section being screwed together on the rod thereby connecting all three sections.

14. A golf putter according to claim 1, wherein the laminated mid-section having a distinctive appearance due to colour selection of the laminations, the laminated body being formed by nipping a row of laminations between the toe section and the heel section and adhering the sections and the laminations into a composite assembly.

15. A golf putter according to claim 1, wherein the sections are mutually connected by the tie rod threading the laminations of the mid-section on the tie rod and connecting the tie rod to the toe and heel sections and compressing the laminations by turning the toe and heel sections on the tie rod.

16. A golf putter comprising:

a composite club head having a section, a heel section and mid-section arranged between said toe and heel sections, said mid-section being composed of a laminated body having multiple laminations connected by respective side faces, plane of said side faces being substantially perpendicular to a plane of striking face the head, end faces of said laminations being substantially vertical with respect a putting surface; and a clamping tie rod passing through said side faces of said laminations wherein both ends of said tie rod being threaded so that said rod is connectable to said toe section and said heel section to clamp said laminations therebetween and wherein said toe section has one or more metal parts and said heel section has one or more metal parts.

* * * * *